United States Patent [19]

Podgers et al.

[11] Patent Number: 4,896,705

[45] Date of Patent: Jan. 30, 1990

[54] CONTAINMENT MANHOLE

[75] Inventors: Alexander R. Podgers, Lake City; Eric J. Butterfield, Fairview, both of Pa.

[73] Assignee: Emco Wheaton, Inc., Raleigh, N.C.

[21] Appl. No.: 374,605

[22] Filed: Jun. 30, 1989

Related U.S. Application Data

[60] Continuation of Ser. No. 166,992, Mar. 10, 1988, abandoned, Division of Ser. No. 17,531, Feb. 24, 1987, Pat. No. 4,763,806.

[51] Int. Cl.[4] ..... B65B 3/06; B67D 5/00

[52] U.S. Cl. ..... 141/86; 141/98; 222/108; 137/312; 137/371; 52/20; 220/85 F; 220/86 R; 404/25

[58] Field of Search ..... 141/86, 98; 222/108; 52/19, 20, 21; 137/368, 369, 370, 371, 372, 312, 367, 364; 404/24, 25; 422/900; 405/52; 220/86 R, 85 R, 85 F

[56] References Cited

U.S. PATENT DOCUMENTS

| | | | |
|---|---|---|---|
| 3,267,957 | 8/1966 | Glennon | 137/364 |
| 4,278,115 | 7/1981 | Briles et al. | 141/86 |
| 4,527,708 | 7/1985 | Dondas et al. | 220/18 |
| 4,593,714 | 6/1986 | Madden | 137/371 |
| 4,615,362 | 10/1986 | Hartman et al. | 141/86 |
| 4,655,361 | 4/1987 | Clover | 220/851 |
| 4,659,251 | 4/1987 | Petter et al. | 405/52 |
| 4,696,330 | 9/1987 | Raudman et al. | 141/86 |
| 4,762,440 | 8/1988 | Argandona | 405/52 |
| 4,763,806 | 8/1988 | Podgers et al. | 220/86 R |
| 4,770,317 | 9/1988 | Podgers et al. | 141/86 X |
| 4,793,387 | 12/1988 | Le Blanc et al. | 141/86 |
| 4,807,675 | 2/1989 | Sharp | 141/86 |
| 4,809,866 | 3/1989 | Crocker | 220/86 R |

FOREIGN PATENT DOCUMENTS

| | | | |
|---|---|---|---|
| 0147050 | 7/1985 | European Pat. Off. | 52/20 |
| 2343651 | 3/1975 | Fed. Rep. of Germany | 52/20 |

*Primary Examiner*—Ernest G. Cusick

*Attorney, Agent, or Firm*—Pearne, Gordon, McCoy & Granger

[57] ABSTRACT

A containment manhole is formed of an upper rim and a bottom sump portion connected by an expansion joint permitting radial and axial movement of the sump portion relative to the rim. The sump portion has an integrally formed drain for the drainage of spilled product in the manhole directly into the riser. The rim also has an upstanding flange and the lid of the manhole extends over the flange with a wide, downwardly sloped skirt directing water off the lid to the outer perimeter.

12 Claims, 3 Drawing Sheets

CONTAINMENT MANHOLE

This is a continuation of application Ser. No. 07/166,992 filed on Mar. 10, 1988, now abandoned, which is a division of application Ser. No. 07/017,531, filed Feb. 24, 1987, now U.S. Pat. No. 4,763,806.

BACKGROUND OF THE INVENTION

1. Field of the Invention

This invention relates to manholes for access to fill pipes from underground storage tanks, and more particularly to a manhole providing a liquidtight construction for containing spills encountered during the filling process.

2. Description of the Prior Art

Because of the growing number of stringent state and local regulations related to leaks in underground fuel storage tanks, a new tank installation system has been developed which will protect ground water from spills, overcome the disadvantages of concrete vaults, and permit early detection of leaks. This tank installation system requires the deliberate maintenance of the tank in a wet hole, i.e., in a hole in the ground in which the tank is surrounded by a pool of water. Because of the difference in specific gravity of gasoline or other petroleum fuel products in water, the development of a leak in the tank then results in ground water from the wet hole flowing into the tank rather than fuel or other petroleum product in the tank flowing out. When a leak occurred in prior tank installations located in a dry hole, the product level in the tank dropped, indicating a leak. However, with a "wet hole" tank installation, water flows in through the leak opening when a leak occurs, and the product level in the tank begins to rise, indicating a leak.

To install a "wet hole" type tank system, the tank hole is lined with a heavy duty impervious membrane, preferably a membrane with a high degree of elasticity. The membrane should be resistant to all forms of hydrocarbon, and such other fuels as methanol. This liner is placed in the bottom of the hole on a pallet and unfolded to cover the sides of the hole to grade level. The tank is balanced through the use of the tie-down straps attached to a concrete pad poured over the liner in the bottom of the hole, or through the use of side ballasts. The tank excavation is then back-filled in the normal manner, and the excavation is flooded with water inside the liner. Finally, the driveway slab is poured over the top of the excavation. The tank is thus completely submerged in the water which is retained within the excavation liner. In the event of a catastrophic spill, a tank rupture for example, the spill product is retained within the liner. In the event of a small leak, water enters the tank, causing the liquid level of the product to rise.

An observation well or manhole should be installed outside the liner at one end of the tank. Prior manhole constructions have generally been unsuitable for such installations because they did not maintain an adequate watertight seal to prevent the water in the liner surrounding the tank from entering the manhole or to prevent spilled fuel from draining into the containment area. Such a manhole should have sufficient flexibility to permit any misalignments of the riser pipe leading up from the tank and to permit the riser to move due to ground shifts when moisture in the soil freezes.

Liquid tight manholes also have applications in which they are installed in underground tank installations which are not of the "wet hole" type. These liquidtight manholes are advantageous as a containment measure in the event that fuel or other product is spilled during the filling process. A liquid tight containment manhole reduces the pollution of ground water and product spillage which may occur during the filling of the underground tank by capturing the overspill and holding it in the containment manhole. The contained product may then be removed from the manhole, or may be drained directly into the underground tank.

Examples of such containment manholes are shown in U.S. Pat. No. 3,633,219, issued to Byrd; patent No. 4,278,115, issued to Briles et al.; and patent No. 4,527,708, issued to Bundas et al. The Briles et al. and Bundas et al. patents show containment manholes each having a flexible seal around the riser pipe at the location at which the riser pipe enters the manhole. The Briles et al. patent also discloses a drain within the manhole through which the spilled product may be removed from the manhole. While Briles et al. disclose draining the product to a separate holding tank, the Byrd patent discloses connecting an exterior drain to the riser pipe so that spilled material may be drained directly into the riser. While these designs provide certain advantages, there are various difficulties resulting from the design of these manholes.

One problem relates to the drainage of the spilled product in the manhole from the manhole into the underground tank. Prior art designs have typically used an external hose connecting the drain in the manhole to a fitting on the riser. A flexible hose has typically been used. However, this hose is susceptible to external damage and internal blockage. Blockage could occur due to debris contained in the manhole which would be drained into the drain hose and block the drain. Damage could result during installation, or due to frost heave or settling, possibly resulting in a leak to the hose or resulting in the hose breaking or becoming disconnected from the riser. Because the manhole is externally fitted and back-filled, it is extremely difficult to remove the manhole to repair the drain hose without excavation of the entire site.

Another problem with the prior art containment manholes related to the use of the elastomeric seal to achieve integrity between the riser pipe and the opening in the manhole through which the riser extended. When the manhole moved axially due to frost heave or settling, the movement could introduce debris into the seal gland and cause damage to the seal or to the surface which the seal must act upon. If either the seal or the surface were damaged, the manhole would no longer contain liquid, since liquid could leak through the damaged seal around the riser pipe.

Another problem also related to the types of seals employed in the prior art manholes. The seals used in the prior art manholes required rather precise glands to hold the seal in a particular relationship to the seal surface. This requirement did not allow for radial movement of the manhole. The manhole might move radially due to tank settling, pavement settling, thermal expansion of the surrounding pavement, or seismic shock. Such radial movement could cause the seal gland to bind and damage the seal or the surface against which the seal acts. Furthermore, radial movement of the manhole could result in the opening in the manhole binding against the riser pipe, resulting in severe stresses transmitted through the riser pipe which could cause damage to the pipe or to the underground tank.

Prior art manholes of both the containment type and conventional non-containment type also had problems in the design of the lid used to close the manhole. Prior art lids typically have sealingly engaged the rim to prevent surface water on top of the lid from draining into the manhole. To reduce the reliance upon this sealing engagement, some prior art lids have been provided with radially extending drainage channels to channel the water from the top of the lid into a trough on the rim of the manhole surrounding the lid. However, water could accumulate in this trough and could freeze in cold weather, making it difficult to remove the lid. This ice formation acted to bond the lid to the rim, and required that the ice be chipped away or otherwise removed before the lid could be pried off the manhole rim.

Another problem with prior art manhole lids resulted from the interrelationship between the lid and the rim. Typical prior art lids were only slightly larger than the top opening of the manhole. Thus, if the lid was not placed exactly over the opening of the manhole, sealing engagement would not be achieved. Furthermore, it would be possible for the lid and rim to close in such a manner that would allow the lid to lift or flip if a load was applied to a portion of the lid. This dislocation of the lid could also create an opportunity for personal injury if a pedestrian were to step on the displaced manhole and slip into the opened manhole. Additionally, it was possible for the lid to lift up and damage the vehicle which might pass over the manhole. To prevent these occurrences, manholes of the prior art were typically formed of metal and made as heavy as possible to reduce the possibility of flipping. However, the resulting manhole lid was difficult to remove and expensive to fabricate.

SUMMARY OF THE INVENTION

The problems and disadvantages of the prior art are overcome by the present invention of a containment manhole and a manhole lid which provide a unique sealing arrangement with the riser pipe and which provide a unique overlapping lid construction. The containment manhole of the present invention allows contained product within the manhole to be directed into the underground tank by means of a drain passage which is integrally cast with the bottom sump portion of the manhole. This integrally cast drain passage provides a liquid path which is less likely to be blocked by debris because of its increasing area and short length. In addition, the size, shape, and location of the drain passage provide easy access for cleanout. Access to the drain passage and cleanout can be provided without excavation of the site. Furthermore, the drain passage, being integrally cast with the bottom sump portion of the manhole, is not susceptible to damage during installation, and cannot be disconnected.

The containment manhole of the present invention also provides for axial as well as radial movement of the riser pipe with regard to the top rim of the manhole. The sump body portion is rigidly attached to the riser pipe and movement of the sump body with respect to the manhole rim is provided for, and containment integrity is maintained by an expansion joint located on the sides of the manhole. This expansion joint is not susceptible to damage from debris, and is protected from internal vandalism by an inner sleeve within the manhole. Radial movement is also allowed by the expansion joint so that the transmission of stress to the underground tank through the riser pipe is prevented.

The unique lid and rim design of the manhole of the present invention comprises a lid which completely covers the manhole, affording protection to the manhole from harsh treatment common in the environment. This design permits the use of softer moldable materials for the manhole body, such as plastic, since the manhole is thoroughly protected by the lid. If the lid wears out, it can be easily replaced.

The lid and rim design of the manhole of the present invention also provides a substantial overlapping of the lid. The overlapping channels water from the lid to the outside perimeter of the manhole. Additionally, the large overlap combined with the inner skirt requires the operator to properly replace the lid after it has been removed. The unique design of the lid requires that the lid be supported away from its outer edge. This support eliminates the fulcrum point about which lids of the prior art were easily lifted or flipped out of location. The rim and the lid of the present design also minimize the contact area to reduce the binding of that device. Furthermore, the sloped perimeter portion of the lid is such that radial loading, such as are incurred from a snow plow, will force the lid onto the rim and prevent removal.

The body of the manhole of the present invention is retained in the concrete or fill media which surrounds the manhole by removable anchoring bolts. This affords easy maintenance or replacement of the manhole without the necessity of breaking up the concrete.

These and other advantages are provided by the containment manhole of the present invention. The manhole comprises a rim extending around the top of the manhole. An outer sleeve extends downwardly from the rim to form the exterior sides of the manhole. An inner sleeve extends downwardly from the rim inside the outer sleeve, and generally parallel thereto. A sump portion forms the bottom of the manhole. The sump portion has a central hole for attachment to the riser pipe. The sump portion has a drain for directing liquid from the bottom of the manhole to the riser pipe. The drain is integrally formed in the sump portion and extends from the bottom of the manhole to the central hole. An expansion joint connects the rim to the sump portion. The expansion joint is located between the inner sleeve and the outer sleeve, and is protected from interior damage by the inner sleeve. The expansion joint allows vertical and horizontal movement of the sump portion relative to the rim.

The containment manhole may also include a drain valve covering the drain in the sump portion and preventing the escape of vapor from the riser pipe, and preventing liquid in the riser pipe from entering the containment manhole through the drain.

In accordance with another aspect of the present invention, a manhole comprises a manhole body having an upper rim forming the upper perimeter of the manhole. The rim has an upstanding flange and a ledge extending outwardly from the flange. A lid on top of the manhole is supported on the flange of the rim. The lid has a downwardly sloped skirt at its outer periphery. The skirt extends over the ledge to direct liquid on top of the lid outwardly toward the ledge.

DETAILED DESCRIPTION OF THE PREFERRED EMBODIMENT

Figure 1:
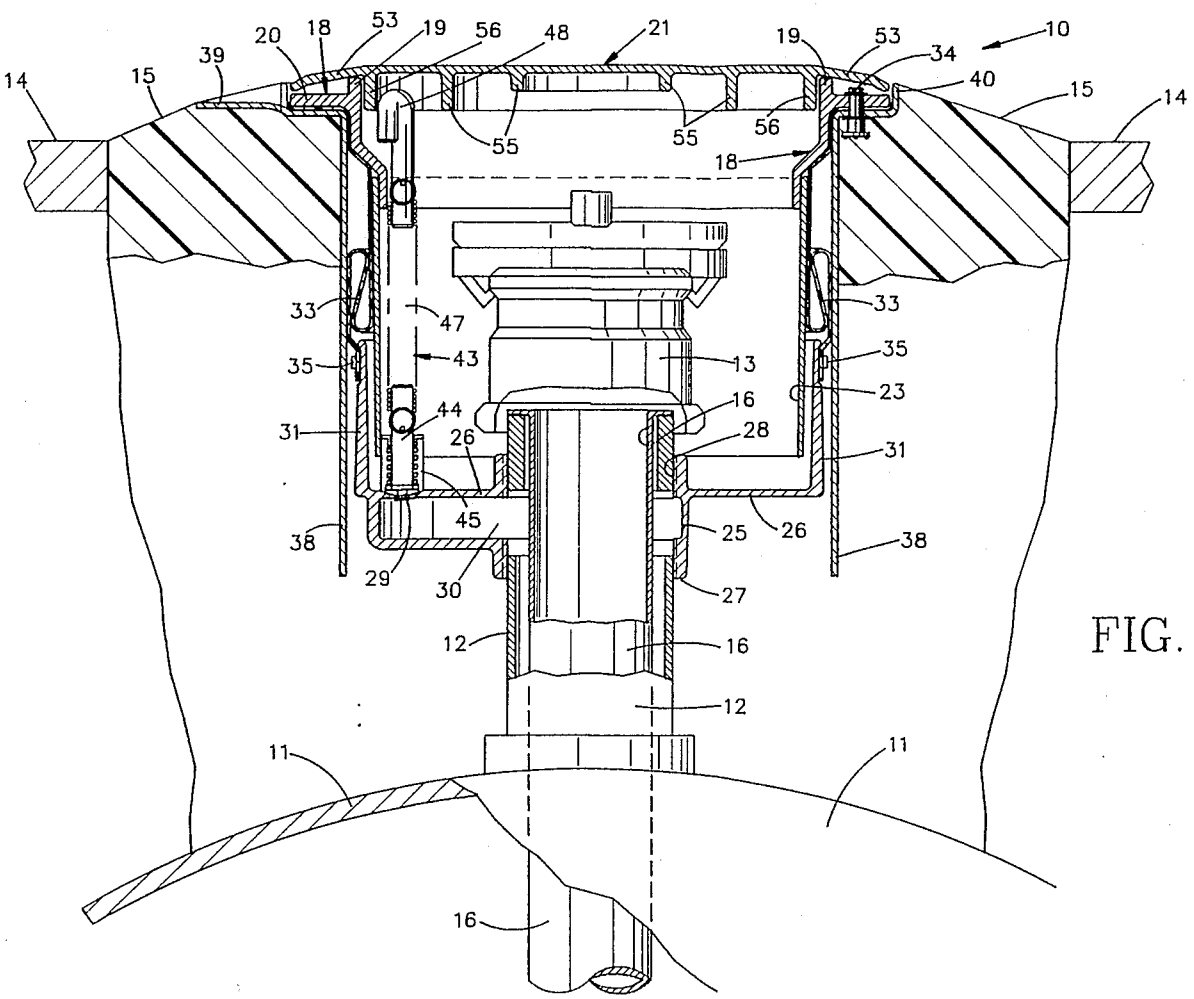
FIG. 1 is a side elevational view, partially in section, showing the containment manhole of the present invention installed in the ground.

Referring more particularly to the drawings, and initially to FIG. 1, there is shown an installation utilizing the containment manhole 10 of the present invention. The installation includes an underground storage tank 11 for gasoline or other products. A riser pipe 12 extends upwardly from the top of the storage tank 11. At the top of the riser 12 is a fitting 13 for connection to the fill line of a tank truck. Extending downwardly from the fitting 13 within the riser 12 is a drop tube 16 which extends to the bottom of the tank 11. The drop tube 16 lines the inside of the riser 12 and is used for filling the storage tank 11. The manhole 10 is installed below the surface of the ground, and provides access to the fitting 13 on top of the riser 12.

The top of the manhole 10 is preferably above the grade level 14 surrounding the installation, with a sloped crown 15 being provided around the manhole during installation. Preferably, the manhole 10 is at least two inches above grade level 14 in order to assure proper drainage of water from the top of the manhole down and away from the manhole. The crown 15 is typically formed of concrete during the installation of the manhole.

Figure 2:
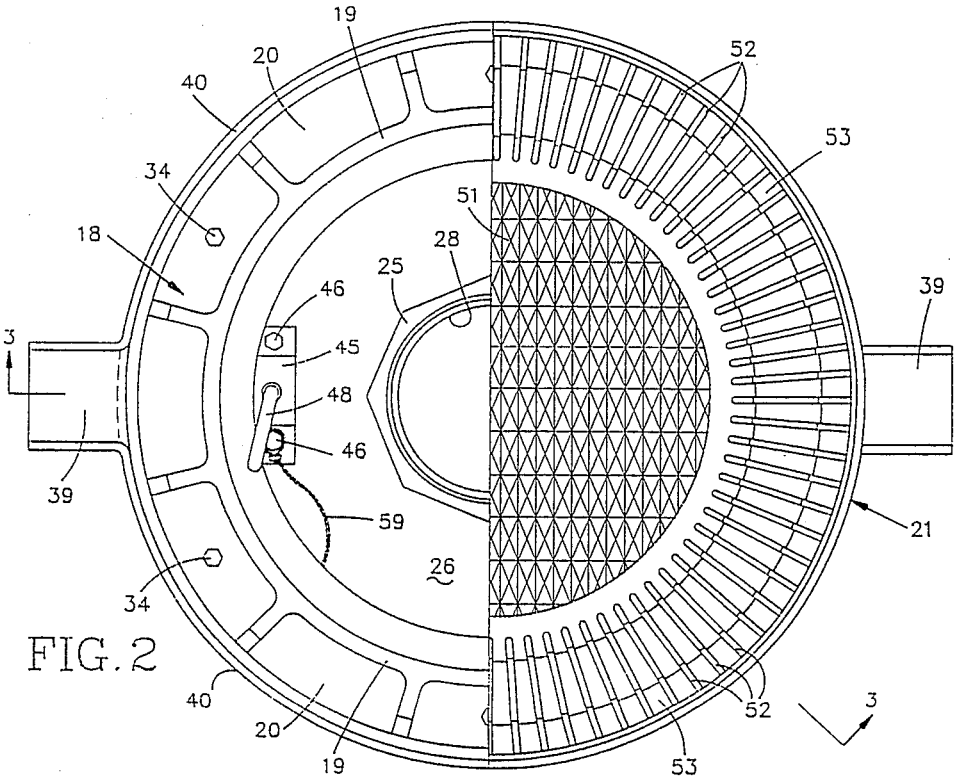
FIG. 2 is a top plan view of the manhole of FIG. 1.
Figure 3:
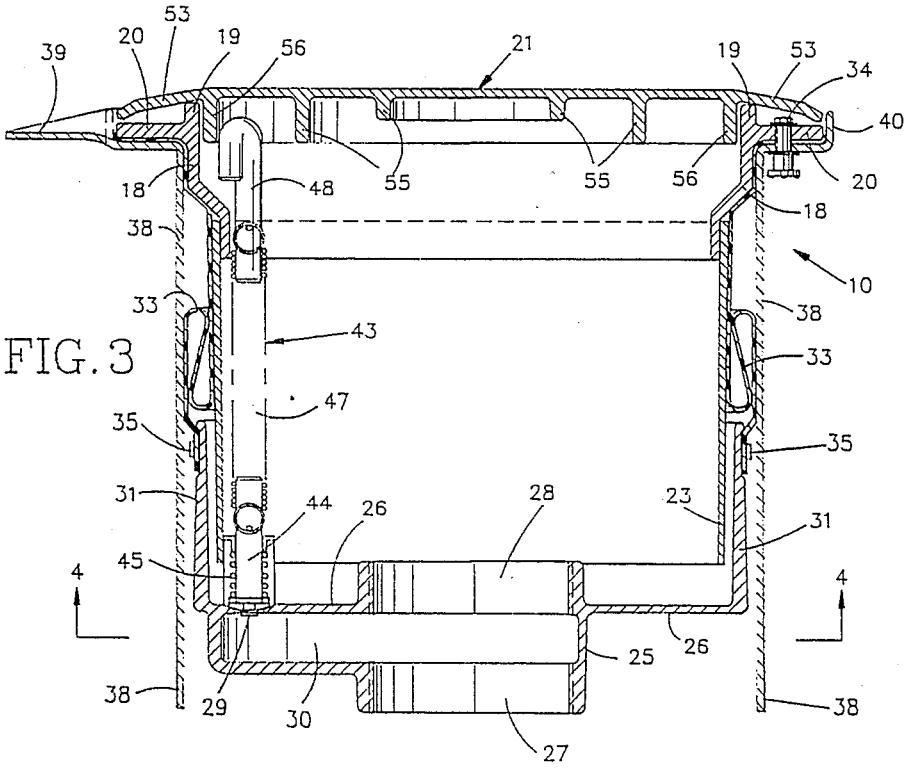
FIG. 3 is a side sectional view, taken along line 3—3 of FIG. 2.
Figure 5:
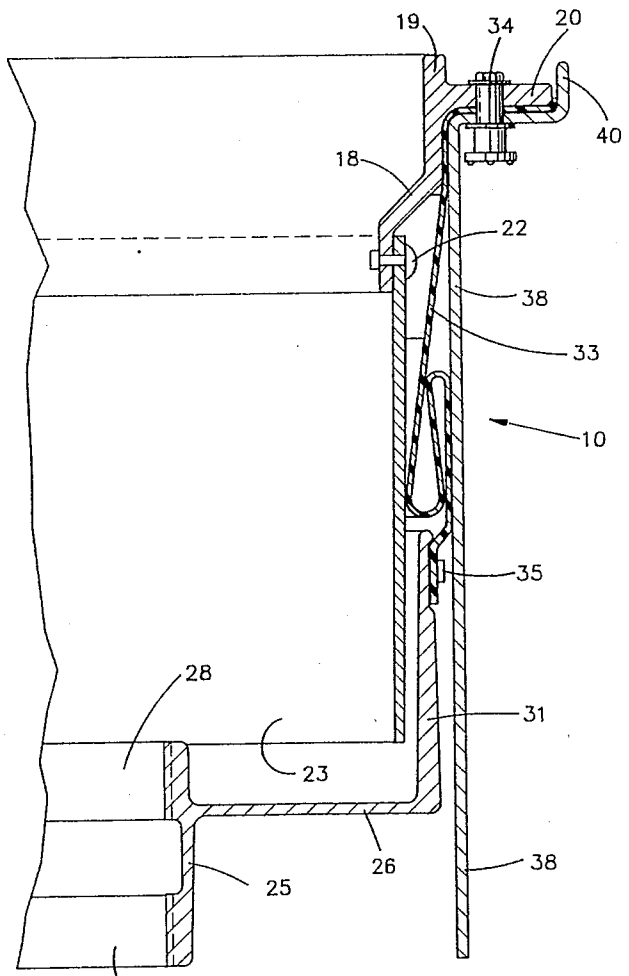
FIG. 5 is a detailed, sectional view of a portion of the manhole of FIG. 3 to a larger scale.
Figure 4:
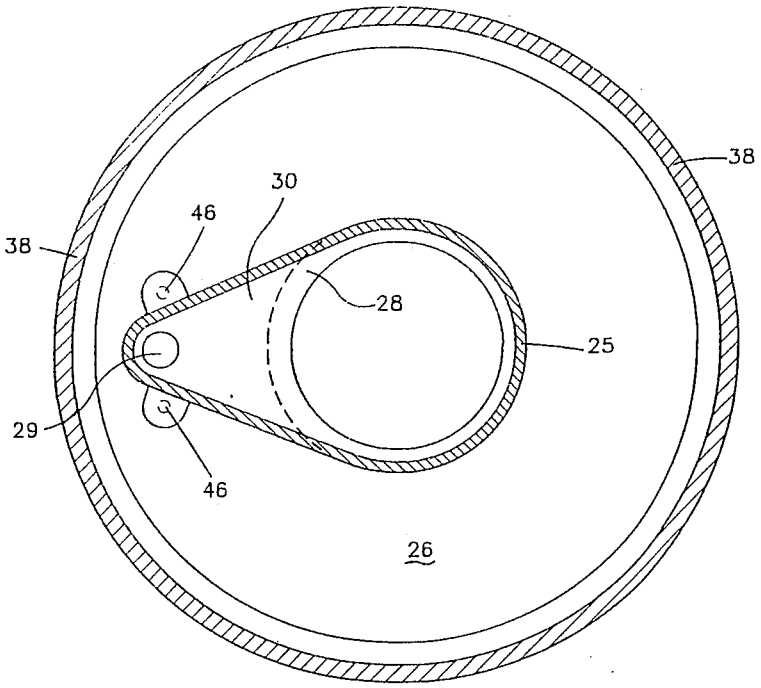
FIG. 4 is a bottom sectional view taken along line 4—4 of FIG. 3.

The manhole 10 can be seen in greater detail in FIGS. 2, 3, and 4. As shown therein, the manhole 10 includes a circular rim 18 forming the top of the manhole. The rim 18 includes an upstanding flange 19 and a radially extending ledge 20 extending outwardly from the flange. The flange 19 supports a circular lid 21 which fits over the rim 18 and covers the entire top of the manhole, including the flange.

The rim 18 also extends downwardly from the flange 19 to form the upper portion of the manhole. The lower portion of the rim 18 tapers inwardly so that this portion of the rim has a reduced diameter. The lower reduced diameter portion of the rim 18 may be connected by means of rivets 22 to a cylindrical inner sleeve 23 which extends downwardly from the rim 18 and forms the interior side walls of the manhole. Alternatively, the rim 18 and the sleeve 23 may be formed as a single piece. The rim 18 and the sleeve 23 may be formed of any suitable material, including metal, plastic, or rubber.

The bottom of the manhole 10 is formed by a bottom portion or sump portion 26. The sump portion 26 includes a central collar 25 having a threaded opening 27 for connection to the riser pipe extending upwardly from the underground storage tank, and a threaded opening 28 directly above the opening 27 for connection to the fitting 13 provided at the top of the riser. The sump portion 26 is generally cup-shaped, and includes vertically extending sides 31 which extend upwardly from the bottom of the manhole and extend outside the inner sleeve 23. The sump portion 26 may also have a drain opening 29 provided at the bottom of the manhole, through which gasoline or other petroleum products which may be spilled in the manhole can be drained out of the manhole.

The drain opening 29 connects with an integrally formed drain 30. The other end of the drain 30 connects to the collar 25 between the threaded openings 27 and 28 providing drainage into the riser 12. The drain 30 is formed as an integral part of the sump portion 26 and, as shown in FIG. 4, increases in size from the drain opening 29 to the threaded openings 27 and 28. The drain 30, being integrally cast with the sump portion 26, is not susceptible to damage during installation, and cannot be inadvertently disconnected. Since the drain 30 is integrally formed with the sump portion 26, and since it provides a wide opening into the connection with the riser 12, easy access to the drain is provided, and the drain may be cleaned out without requiring excavation of the entire site, which was necessary with drain hoses of the prior art.

The sump portion 26 is connected to the rim 18 by an expansion joint 33. The top of the expansion joint 33 is connected to the rim 18 by means of anchoring bolts 34, which also serve to retain the manhole in the concrete or fill media which surrounds the manhole. The bottom of the expansion joint 33 is connected to the upper portion of the sides 31 of the sump portion 26 by means of a band clamp 35. Since the expansion joint 33 is clamped at each end to the rim 18 and the sump portion 26, it is not necessary for the expansion joint to form a movable seal against another portion of the manhole or against the riser pipe, as was required in the containment manhole designs of the prior art.

When installed, the expansion joint 33 is folded over on itself, as shown in FIG. 3. This allows for substantial axial movement of the sump portion 26 with respect to the rim 18. In addition, because one side of the expansion joint 33 may be moved axially while the other side may not, substantial radial movement of the sump portion 26 with respect to the rim 18 is accommodated by the expansion joint 33. The expansion joint 33 thus isolates the riser 12 from the grade in which the manhole rim 18 is anchored, so that frost heave, and even mild seismic shock, will not rupture the manhole or cause damage to the riser 12 or to the underground storage tank 11. Since the expansion joint 33 provides for radial movement of the rim 18 with respect to the sump portion 26, the transmission of stress to the underground tank 11 through the riser pipe 12 is prevented.

The expansion joint 33 is protected on the exterior of the manhole by a gravel guard or cylindrical outer sleeve 38. The outer sleeve 38 extends downwardly directly beneath the rim 18 and is attached to the rim by the bolts 34. The outer sleeve 38 extends downwardly from the rim around the exterior of the expansion joint 33 to provide protection to the expansion joint from gravel and other backfill material which surround the manhole during installation. The outer sleeve 38 is radially spaced from the inner sleeve 23 to provide a substantial annular chamber for the expansion joint 33 to be folded over on itself. The expansion joint 33 is thus protected from damage caused by activity within the manhole and other interior damage or vandalism by the inner sleeve 23, and is protected from exterior damage by the outer sleeve 38.

As shown in FIG. 3, the top of the outer sleeve 38 is provided with an upstanding lip 40 which extends upwardly from the end of the ledge 20 of the rim 18. The lip 40 protects the rim 18 and protects the edge of the lip 21 from damage which may occur, for example, from a snow plow or other means moving over the top of the manhole which would otherwise tend to displace the lid. The lip 40 also provides a form for properly molding the concrete around the manhole during installation. The height of the lip 40 should be no greater than the height of the flange 19, so that water which accumulates on the ledge 20 will drain over the lip and away from the manhole rather than over the flange and into the manhole.

As shown in FIGS. 2 and 3, the top of the outer sleeve 38 is also provided with a pair of troughs 39 for channeling water accumulated on the ledge 20 of the rim 18 past the lip 40 and outwardly away from the manhole. The drainage provided by the troughs 39 reduces the accumulation of water in the rim ledge 20 which can freeze and make it more difficult to remove the lid of the manhole.

The drain 30 is closed by means of a drain valve assembly 43. The drain valve assembly 43 comprises a plug 44 held within a plug retainer bracket 45. The bracket 45 is connected to the sump portion 26 by screws 46. An extension spring 47 is connected to the top of the plug 44, and a handle 48 is connected to the top of the spring 47. To open the drain valve assembly 43, the operator pulls on the handle 48, causing the spring 47 to pull the plug 44 away from the drain 30.

If desired, the operator may hook the handle 48 over the flange 19 of the rim 18 to leave the drain open and permit full drainage of the accumulated product in the manhole down through the riser. With the handle 46 hooked over the flange 19 of the rim 18, the lid 21 will not fit properly. This provides a simple visual indication to assure that vapor in the storage tank 11 does not vent through the manhole if the drain valve assembly 43 is inadvertently left open.

As shown in FIG. 2, the circular lid 21 comprises a central skid-resistant portion 51. Surrounding the portion 51 are a plurality of radially extending grooves 52 which are intended to direct water from the top of the lid 21 outwardly to the manhole rim 18, as well as to provide skid resistance. As can be seen in FIG. 3, the outer periphery of the lid 21 includes a downwardly sloping skirt 53 which extends over the ledge 20 of the rim 18 when the lid is in place. The radially extending grooves 52 are formed in the skirt 53 so that water on the top of the lid 21 drains downwardly and outwardly off the lid and onto the ledge 20 of the manhole rim 18. The water on the ledge 20 is then drained off the ledge by means of the troughs 39 formed in the outer sleeve.

The lid 21 also includes a plurality of reinforcing ribs 55 formes on the bottom surface of the lid. A circular outer rib 56 is provided on the bottom of the lid 21 at the approximate location at which the skirt 53 begins. The outer rib 56 fits just within the flange 19 of the manhole rim 18 to assure that the lid 21 is properly placed on the rim.

The lid 21 is preferably formed of aluminum. A lightweight material, such as aluminum, can be used for the lid 21, since the maintenance of the lid in its proper position does not depend upon the weight of the lid. The lid 21 is resistant to being displaced inadvertently by the juxtaposition of the outer rib 56 of the lid with the flange 19 of the rim 18. If the lid 21 is displaced, the lid will not fit properly on the rim 18, and the displacement of the lid will be easily detected. Even if the lid 21 is inadvertently displaced, the design of the lid and the rim 18 is such that the outer rib 56 upon which the lid is supported is not adjacent to the outer periphery of the lid. Thus, the lid 21 is not supported solely around its outer edge. This design does not provide a fulcrum point about which the lid can easily lift or flip out of position.

Since the lid 21 rests upon upstanding flange 19 of the rim 18, and not upon the rim ledge 20, the lid contacts the rim ledge only along a small surface area at the outer periphery of the lid. This design minimizes the contact area between the rim 18 and the lid 21, and reduces the bonding effect of ice which may be formed in the ledge 20.

The anchoring bolts 34 serve not only to attach the expansion joint 33 to the rim 18 but to anchor the manhole in the concrete or fill media surrounding the manhole. Once installed, the manhole, including the rim 18, the sleeve 23, the expansion joint 33, and the sump portion 26, may be removed for servicing by loosening the nuts from the bolts 34 and lifting the manhole body out. This allows for the manhole body to be maintained or replaced without breaking or removing the concrete.

If desired, a grounding wire 59 may be provided to assure that the sump portion 26 is properly grounded with respect to the rim 18. One end of the grounding wire 59 may be connected to one of the screws 46 which holds the plug retainer bracket 45 to the sump portion 26. The outer end of the grounding wire 59 may be connected to one of the bolts 34 which connect the outer sleeve 38 and the expansion joint 33 to the rim 18.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A manhole comprising:

a manhole body having an upper rim forming the upper perimeter of the manhole, the rim having an upstanding flange and a ledge extending outwardly from the flange, the body also having an outer lip extending upwardly from the outer edge of the ledge, the body also having a trough extending radially outwardly through the lip to channel liquid on the ledge outwardly pass the lip and to reduce the accumulation of liquid on the ledge; and a lid on top of the manhole supported on the flange of the rim and covering the flange, the lid having a downwardly sloped skirt at its outer periphery, the skirt extending over the ledge to direct liquid on top of the lid downwardly toward the ledge, the skirt being vertically spaced from the ledge to minimize the contact area between the rim and the lid and to facilitate the insertion of a tool or fingers between the skirt and the ledge to remove the lid.

2. A manhole as defined in claim 1, wherein the height of the lip is no greater than the height of the flange so that liquid collected on the ledge will drain over the lip rather than drain over the flange into the manhole.

3. A containment manhold as defined in claim 2, wherein the lip provides a form for casting concrete in which the manhole is set.

4. A manhole as defined in claim 1, wherein the lid has a plurality of radially extending grooves to assist in channeling liquid outwardly toward the skirt.

5. A manhole as defined in claim 1, wherein the lid has a downwardly extending rib fitting inside the rim flange to assist in proper placement of the lid.

6. A manhole as defined in claim 1, wherein the body also comprises:

an outer sleeve extending downwardly from the rim to form protecting exterior sides of the manhole;

a sump portion forming the bottom of the manhole, the sump portion being rigid and having a central hole for rigid attachment to a riser pipe, the sump portion having a drain for directing liquid from the bottom of the manhole to the riser pipe, the drain extending from the bottom of the manhole to the central hole; and an expansion joint connecting the rim to the sump portion, the expansion joint located inwardly of the outer sleeve, the expansion joint being protected from exterior damage by the outer sleeve, the expansion joint being flexible and allowing substantial vertical movement and substantial horizontal movement of the sump portion relative to the rim.

7. A manhole as defined in claim 6, comprising, in addition, a drain valve covering the drain in the sump portion and preventing the escape of vapor from the riser through the manhole body.

8. A containment manhole as defined in claim 6, wherein the rim is connected to the outer sleeve by removable anchoring means, whereby the rim and the sump portion attached to the rim may be removed for maintenance and replacement without removing the outer sleeve or affecting any concrete around the outer sleeve.

9. A manhole as defined in claim 6, wherein the sump portion of the body forms the entire bottom of the manhole.

10. A manhole as defined in claim 6, wherein the expansion joint includes a plurality of folds to increase the range of allowable motion by the sump portion relative to the rim.

11. A manhole as defined in claim 6, comprising in addition an inner sleeve extending downwardly from the rim inside the outer sleeve and generally parallel thereto, the expansion joint being protected from interior damage by the inner sleeve.

12. A manhole as defined in claim 6, wherein the drain is integrally formed in the sump portion.

* * * * *